United States Patent [19]

Blumenberg et al.

[11] 4,063,340

[45] Dec. 20, 1977

[54] METHOD OF MANUFACTURING A UNITIZED IN-LINE ELECTRON GUN

[75] Inventors: Horst H. Blumenberg, Elmwood Park; Kenneth A. Guzowski, Chicago, both of Ill.

[73] Assignee: Zenith Radio Corporation, Glenview, Ill.

[21] Appl. No.: 736,791

[22] Filed: Oct. 29, 1976

Related U.S. Application Data

[62] Division of Ser. No. 649,630, Jan. 16, 1976.

[51] Int. Cl.[2] ..... H01J 9/18

[52] U.S. Cl. ..... 29/25.16

[58] Field of Search ..... 29/25.16, 25.15, 25.13; 316/19

[56] References Cited

U.S. PATENT DOCUMENTS

| | | | |
|---|---|---|---|
| 2,950,406 | 8/1960 | Barnett et al. | 313/411 |
| 3,081,526 | 3/1963 | Donnell | 228/175 |
| 3,686,727 | 8/1972 | Say et al. | 29/25.16 |
| 3,725,712 | 4/1973 | Sawagata | 313/262 X |

*Primary Examiner*—Richard B. Lazarus
*Attorney, Agent, or Firm*—Ralph E. Clarke

[57] ABSTRACT

For unitized, in-line electron guns for television color cathode ray tubes, an improved method for mounting the convergence cup is depicted and described. The method facilitates production assembly and provides accurate alignment of the convergence cup with respect to the main gun assembly.

2 Claims, 6 Drawing Figures

METHOD OF MANUFACTURING A UNITIZED IN-LINE ELECTRON GUN

CROSS-REFERENCE TO RELATED APPLICATIONS

This application is a division of copending application Ser. No. 649,630, filed Jan. 16. 1976, and is related to but in no way dependent upon copending applications including: Ser. No. 494,123, filed Aug. 2, 1974 now Pat. No. 3,995,194; Ser. No. 655,592, filed Feb. 5, 1976; Ser. No. 642,049, now Pat. No. 4,032,811, filed Dec. 18, 1974; and Ser. No. 689,611, filed Apr. 24, 1976. All are of common ownership herewith.

BACKGROUND OF THE INVENTION

This invention relates generally to improved unitized, in-line electron guns for color cathode ray tubes and their manufacture and more specifically to an improved method of mounting of the convergence cup.

Unitized, in-line electron guns generate three coplanar electron beams developed by the thermionic emission of heated cathodes arranged in-line. The resulting beams are formed and focused by a tandem succession of electrodes spaced along the central axis of the gun. The electrodes cause the beams to converge at multiple phosphor groups located on the faceplate of the color cathode ray tube. The prime objective in the design of such guns is to provide small spot size and enhanced resolution. To accomplish this objective, the electron gun electrodes and their field forming surfaces should be accurately spaced, the opposing faces of the electrodes should be parallel, and the beam passageways that extend from the point of beam origin at the cathodes in the base area of the gun and through to the convergence cup at the opposite end, should be coaxially aligned.

This invention is concerned with mounting and proper alignment of the convergence cup which exerts the final influence on the three beams in their respective paths of travel to a point of common convergence on the viewing screen. Contact springs are also mounted on the convergence cup; these center the electron gun within the neck of the cathode ray tube. Also, the contact springs carry the high voltage potential of the conductive coating on the inner surface of the tube neck to the convergence cup. The potential is then transferred to the electrodes that comprise the electron-optical lens of the gun.

The precision with which the convergence cup is aligned with respect to the main gun assembly is a particularly critical factor in the performance of unitized, in-line guns. In such guns, the three beams must be coplanar; that is, they must have their origin in a common cathodic plane, and they must remain in the same plane in their passage throughout the gun. If the convergence cup is mounted in angular misalignment, the "landing line" of the three beams will not lie exactly in the horizontal meridional plane at the viewing screen, with the consdequence that misregistration of beams-to-phosphor-elements on the screen will be severe. Also, any translational misalignment of the convergence cup in a radial direction can exert an equally deleterious effect on gun performance in that the beam passageways will no longer be coaxial. In view of the fact that there are no supplementary means for correcting such types of convergence cup misalignment such as adjustable magnets or pole pieces located externally or internally, the need for a method of precision mounting of the convergence cup at the time of manufacture is mandatory.

The standard method of electron gun assembly is to mount the beam focusing electrodes and the convergence cup sequentially on two parallel mandrels of identical diameters, one round in cross-section and the other diamond-shaped, and so spaced and fixtured as to be concentric with the preferred paths of travel of the two outer electron beams. The electrodes are stacked on the two mandrels along with suitable spacers, with the two mandrels passing through the two outer beam-passing apertures of each electrode. This system of assembly, which is a standard manufacturing procedure, ensures the coaxiality of the three beam passageways, and the proper spacing and parallelism of the components so assembled. The assembly is then bonded into a coherent, mechanically sound structure by a beading process in which two or more glass beads are heat-softened and pressed upon the holding claws of the gun electrodes. Upon cooling of the beads, all parts are permanently fixed in proper relationship one to the other.

This invention finds useful application in connection with a unitized, in-line gun structure and its manufacture. The afore-described method of gun component assembly is not suitable for mounting the convergence cup of the gun described in this disclosure because of the presence of two shunt magnets which encircle the two outer beam apertures where the beams emerge from the base of the convergence cup. To exert their beneficial effect on the two outer beams, it is necessary that the inner diameter of these circular shunt magnets be smaller than the diameter of the outer beam apertures in the gun electrodes that precede the convergence cup. As a result, it is not feasible to use the standard mandrelling process as described.

U.S. Pat. No. 3,873,879 (Hughes) describes a unitized in-line electron gun having a "shield cup" whose configuration and function is similar to that of the convergence cup described in the present invention. Hughes does not address the method of properly registering the shield cup with the other gun electrodes during manufacture to prevent misalignment. The method of shield cup mounting appears to be by welding the cup directly to a flange protruding from the second accelerating and focus electrode.

Dogget et al in U.S. Pat. No. 3,614,502 recite a method for the self-registration of a pole-piece type convergence cage used in a *non-unitized,* in-line gun of barrel-type construction. Dogget et al teach a self-registering attachment system of the convergence cage. To make this attachment possible, annular flanges are welded to the accelerating grid electrode of each gun, and the center flange has therein two cut-outs for registration with two holes located in the base of the convergence cage. For reasons which will become clear only after the following description of the unique gun with which this invention is advantageously associated and its assembly problems, the Dogget et al disclosure provides no answer to the above-described unitized in-line gun assembly problems.

OBJECTS OF THE INVENTION

Accordingly, it is a general object of this invention to provide an improved method of manufacturing a unitized, in-line electron gun.

It is a more specific object to provide an improved method for the mounting of the convergence cup of unitized, in-line guns that ensures precise alignment of the convergence cup with all other electrodes of the gun.

BRIEF DESCRIPTION OF THE DRAWINGS

The features of the invention which are believed to be novel are set forth with particularity in the appended claims. The invention, together with further objects and advantages thereof may be best understood, however, by reference to the following description taken in conjunction with the accompanying drawings, in which the several figures of which like reference numerals identify like elements, and in which:

DESCRIPTION OF THE PREFERRED EMBODIMENT

The unitized, in-line type electron gun offers many advantages over other types of guns in common use for color cathode ray tubes — e.g., the discrete delta-cluster gun. The cost advantages of in-line gun, striped screen tubes, especially in terms of savings and convergence hardware, circuitry and implementing set-up labor are well-known. The advantages of unitization of gun structure are also well-known. A few of these advantages include: the gun has fewer parts; the "unitizing" of the control grid and accelerating grid each results in fewer connections and circuits; convergence is simplified so that a typical number of twelve convergence adjustments required for the delta gun tube has been reduced to two or three in the in-line system.

Figure 1:
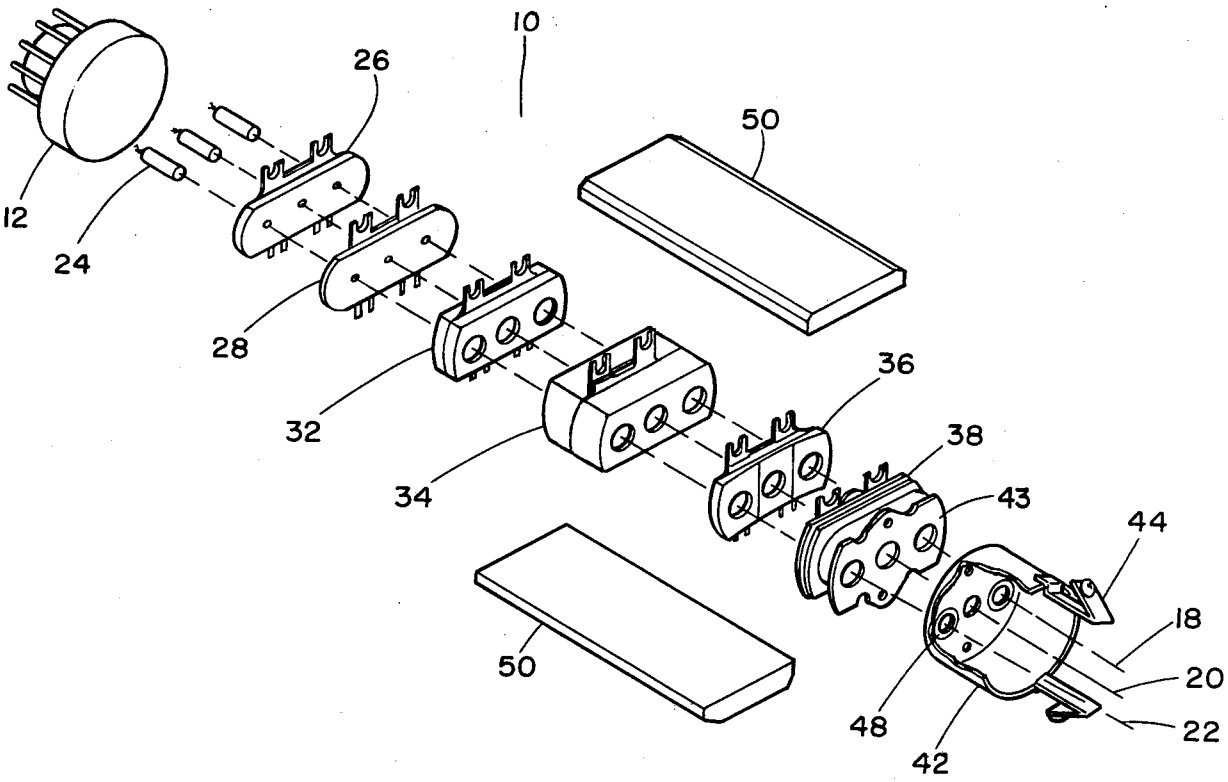
FIG. 1 is an exploded view in perspective of the elements of a color cathode ray tube unitized, in-line gun embodying this invention.
Figure 2:
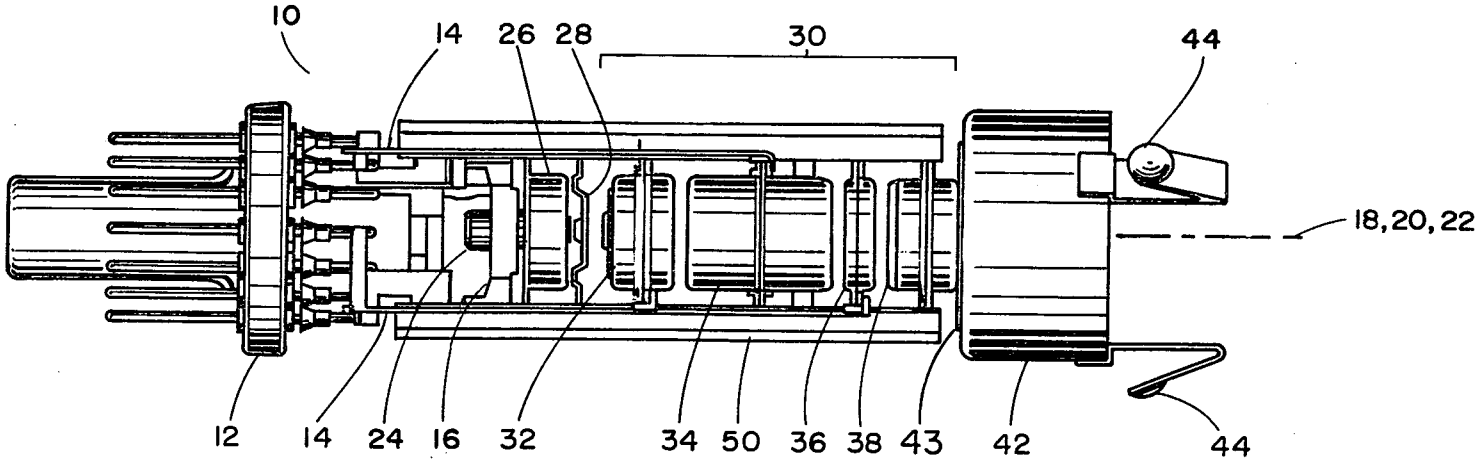
FIG. 2 is an assembled side view of the gun shown in FIG. 1.

Whereas the invention can be used with several different gun structures, a preferred gun is illustrated in FIGS. 1–6. FIG. 1 is an exploded view in perspective of a unitized, in-line electron gun 10 for use in a color television cathode ray tube, and FIG. 2 is an assembled side view of the subject gun. As is well-known in the art, such a gun structure for a cathode ray tube is located at the base of the cathode ray tube in the narrow neck region opposite the faceplate. The electron gun 10 generates three coplanar electron beams, each of which is formed, shaped and directed to selectively energize phosphor elements located on the imaging screen in the expanded area at the opposite end of the cathode ray tube envelope.

Referring to FIGS. 1 and 2, a cathode ray tube base 12 provides a plurality of electrical connections for introducing into the glass envelope the video and blanking signals as well as certain voltages for beam forming and focusing. The operating signals and voltages are conveyed to the several electrodes and grids of gun 10 within the glass envelope by means of several internal electrical leads, two typical ones of which are shown by 14. The three electron-emitting cathodes 24 of the heater-cathode assembly 16 generate three coplanar beams of electrons 18, 20 and 22 which travel through a series of focusing electrodes and a convergence cup to energize the red, green and blue phosphors respectively located on the imaging surface of the television cathode ray tube through a multi-apertured color selection electrode (not shown). A unitized, disc-type accelerating grid 28 follows a control grid 26 in the progression of the three electron beams from the cathodes 24 to the imaging screen. The three beams then enter the electrostatic fields of the main focusing lens 30, consisting of unitized electrodes 32, 34, 36 and 38. Each electrode in main focusing lens 30 carries a predetermined and constant voltage. The electrodes collectively establish a beam focusing field, or an "electrostatic lens" for each beam. This type of lens, also referred to as an "extended field lens", utilizes the principles of the extended field lens described and claimed in U.S. Pat. No. 3,895,253 by Schwartz et al.

Referring again to electron lens 30 of FIGS. 1 and 2, the main focusing lens electrodes 32, 34, 36 and 38 (electrode 38 is termed the "last focus electrode" in this disclosure), each contain three electrically shielding beam-passing tubes therethrough formed from the electrode material. The beam-passing tube concept does not constitute, per se, an aspect of this invention, but is described and claimed in copending application Ser. No. 655,592. Each electrode 32, 34, 36 and 38 is electrically isolated from the others to establish the focusing fields of the electron lens which they comprise.

The difference in potential between adjacent focusing electrodes 32, 34, 36 and 38 establishes a series of focusing field components capable of shaping a beam of electrons flowing through the field components, according to the principles of electron optics. In the unitized, in-line gun that is the subject of this disclosure, the potentials between electrodes 32, 34, 36 and 38 may, for example, have an axial potential distribution which varies monotonically from a relatively intermediate potential at electrode 32, to a relatively low potential at electrode 34, and varies again monotonically to a relatively intermediate potential on electrode 35, to a relatively high potential at electrode 38. This axial potential distribution concept is the subject of the referent copending application Ser. No. 494,123.

Further shaping, directing and focusing of the electron beam is accomplished between electrodes 36 and 38, the configuration of which constitutes two separate electron lens components for converging the outer two beams 18 and 22 inwardly to a common point of combination with central beam 20, which does not vary from a direct axial path. The convergence of beams 18 and 22 towards center beam 20 is accomplished by a slight inward bias shape of the two electrode faces of the two outer beam apertures of electrode 36, and a parallel, matching bias shape on the facing members of electrode 38. The bias-shaped electrode concept does not constitute, per se, an aspect of this invention but is described and claimed in copending application Ser. No. 689,611.

The last in the series of elements that comprise electron beam gun 10 is the convergence cup 42. Convergence cup 42 provides a mounting base for the three contact springs 44 which in turn hold the forward end of the gun firmly centered in the neck of the cathode ray tube; also, through contact with the electrically conductive coating on the inside of the neck of the tube, contact springs 44 convey the high voltage potential to convergence cup 42, and thence to last focus electrode 38. Located within the cup, and adjacent to the apertures from which electron beams 18 and 22 emerge are the shunt magnets 48.

Convergence cup 42 is bonded to last focus electrode 38 in exact registration by means of a carrier plate 43, which lies between the two elements. Since convergence cup 42 is the final element in the series of electrodes that constitute the electron gun, any misalignment of the cup can exert a deleterious effect upon the action of the beams in their final paths of travel to the viewing screen.

In the unitized, in-line gun described in this disclosure, the electrodes have on each side thereof at least one pair of widely spaced, relatively narrow claws embedded at widely spaced points on beads 50. This structural concept does not constitute, per se, an aspect of this invention but is described and claimed in copending application Ser. No. 642,049.

The convergence cup mounting method of this invention will now be described. In conventional gun assembly the electrodes are "stacked" on two parallel mandrels fixtured so as to be concentric with each of the two outer beam passing apertures of each electrode. However, the convergence cup cannot be assembled by this common mandrel system because the two outer beam passing aperture diameters in the base of the convergence cup are caused to be smaller in diameter than the aperture diameters of the preceding electrodes in the gun. The reason for the smaller diameter lies in the fact that the shunt magnets that encircle each of the apertures are themselves smaller in diameter because it is necessary that the magnets lie closer to the beams to exert the proper influence upon the beams. In terms of exemplary dimensions, the diameter of the two outer beam aperture holes in the convergence cup are 0.160 inch (4.06 mm), while the diameter of the two outer beam electrode apertures is typically 0.226 inch (5.74 mm). So the diameters of the aperture holes in the convergence cup are smaller by 0.66 inch (16.7 mm) due to the magnets 48.

Figure 3:
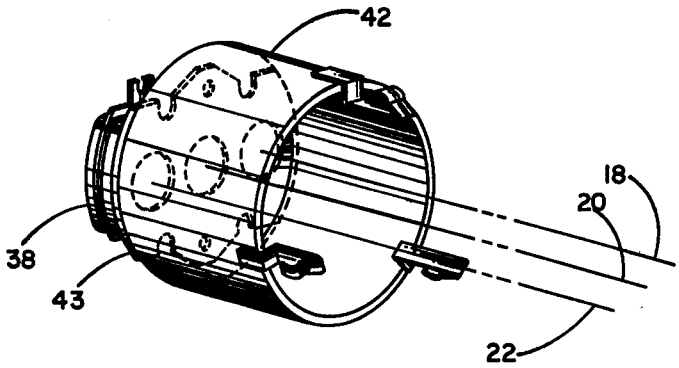
FIG. 3 is a side view in perspective and partly in phantom of the convergence cup and attached components configured in the preferred embodiment of this invention and prepared for mounting.
Figure 4:
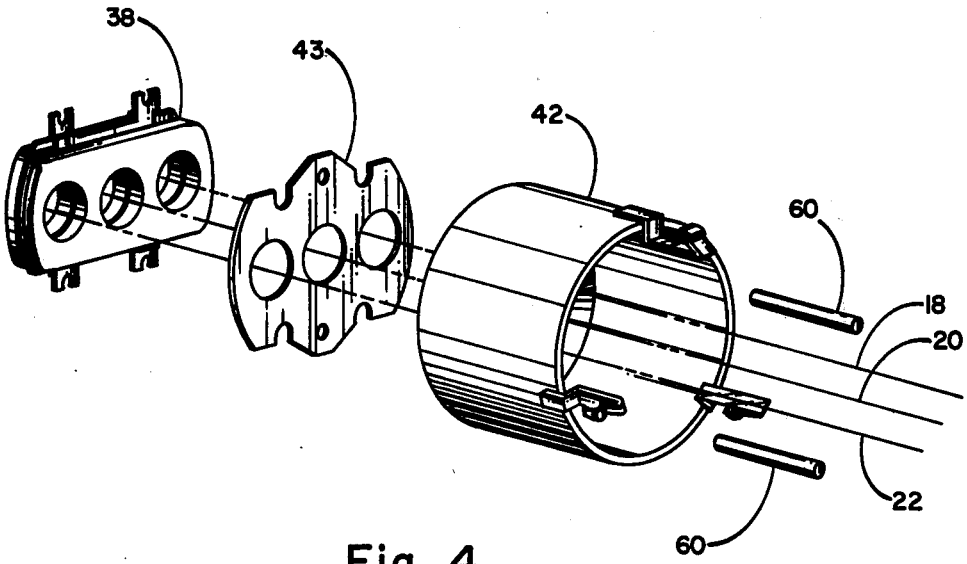
FIG. 4 is an exploded view of the main components of the assembly shown in FIG. 3, and including tooling pins used in assembling certain components of the structure.
Figure 5:
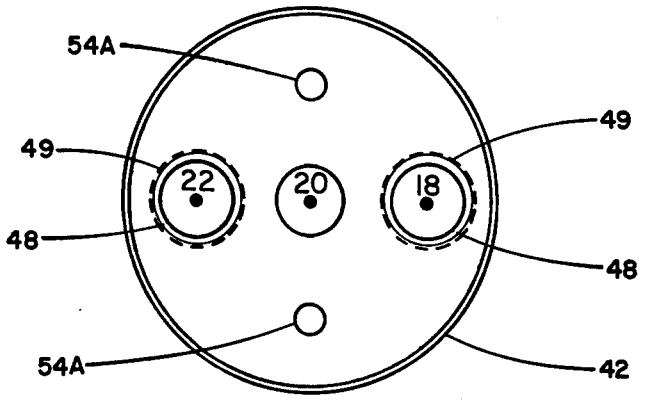
FIG. 5 is a view looking into the base of the convergence cup.

The preferred structure for resolving the problem of precise mounting of the convergence cup is shown in FIGS. 3, 4, 5 and 6 (as described and claimed in parent application Ser. No. 649,630). Referring to FIG. 3, which is a partially phantom view, the convergence cup 42 is shown assembled to last focus electrode 38; that is, the last electrode of main focus lens 30 described heretofore. The two items 38 and 42 are attached by means of intermediate carrier plate 43. Referring now to FIG. 4, which is an exploded view of the assembly shown in FIG. 3, the relationship of carrier plate 43 to convergence cup 42 is further illustrated. FIG. 5 provides a view of the base of the convergence cup looking into the cup. In this Figure, the three beam-passing tubes for beams 18, 20 and 22 are shown. The two shunt magnets 48 encircle the outer apertures for beams 18 and 22 in the convergence cup 42 effectively reducing their diameters by 0.66 inch (16.7 mm). The peripheral dashed lines 49 that encircle the outer beam apertures indicate the larger diameters of the two outer beam tubes of the electrodes of electron gun 10 that precede convergence cup 42. It is obvious that the smaller effective diameters of the two outer apertures of the convergence cup, as defined by the shunt magnets 48, makes it unfeasible to use the conventional mandrelling procedure for the mounting and alignment of the convergence cup 42 to the last focus electrode 38.

Figure 6:
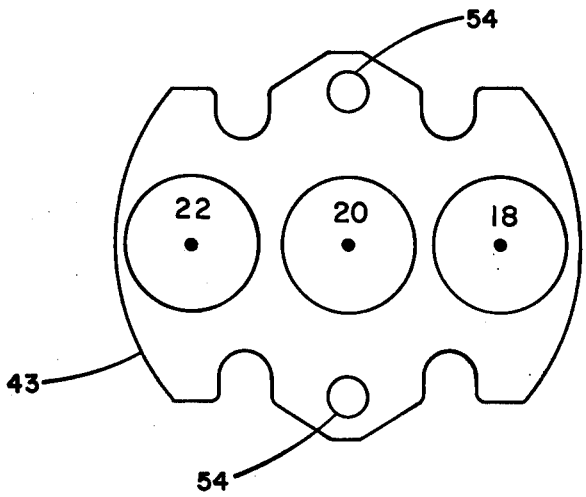
FIG. 6 is an end view of a structure according to this invention, constituting one of the components of the FIGS. 3 and 4 assembly.

The problem is resolved according to the invention of the parent application by addition of carrier plate 43, an end view of which is shown in FIG. 6. Formed in carrier plate 43 are three apertures for passage of beams 18, 20 and 22, said apertures conforming dimensionally to the beam-passing apertures of the last focus electrode of main electron lens 30, and with center-line dimensions in coaxial alignment. Also formed in carrier plate 43 are two tool-passing apertures 54 which are shown as being of identical dimension and which lie in precise coaxiality with the two similar tool-passing apertures 54A located in the base of convergence cup 42, as shown by FIG. 5. The precision with which tool-passing apertures 54 and 54A are preferably made is shown by the following exemplary dimensions: the diameter of tool-passing apertures 54 in carrier plate 43 and tool-passing apertures 54A in convergence cage 42 is 0.0700 inch $\pm$0.0002 inch (1.77 m $\pm$0.0051).

The following method according to this invention is used in the final assembly of the convergence cup and the electron gun. Referring now to FIG. 4, the beam-passing apertures for outside beams 18 and 22 of carrier plate 43 are precisely aligned with corresponding beam-passing apertures of last focus electrode 38 by means of precision mandrels. This combination is then welded together. To facilitate attachment of carrier plate 43 to last focus electrode 38, carrier plate 43 may first be welded to the nearest of the two separate cup-like sections of which last focus electrode 38 is comprised, after which the second cup-like section of last focus electrode 38 is welded to the cup-like section attached to carrier plate 43. The bonded combination of carrier plate 43 and electrode 38 is now added to the succession of electrodes mounted on mandrels inserted through the beam-passing apertures for outside beams 18 and 22 of each electrode. The combination is then permanently assembled by the beading process, using a standard beading fixture. The gun assembly is removed from the beading fixture for attachment of the convergence cup. Convergence cup 42 is precisely aligned with carrier plate 43 by inserting tooling pins 60 through concentric tool-passing apertures 54 and 54A which are formed in carrier plate 43 and the base of convergence cup 42, respectively, following which the combination of cup 42 and plate 43 are permanently bonded together by spot-welding. The convergence cup, when mounted by the means described, exhibits the very close tolerance that characterize the precision manufacture of the unitized, in-line gun that is the subject of this invention.

It must be recognized that changes may be made in the above-described method without departing from the true spirit and scope of the invention herein involved, and it is intended that the subject matter in the above depiction shall be interpreted as illustrative and not in a limiting sense.

What is claimed is:

1. In the manufacture of a unitized, in-line electron gun for a color cathode ray tube having an axial succession of unitized electrodes including a final focus electrode, said electrodes each having therethrough three beam-passing apertures aligned with the beam-passing apertures in other electrodes, a method for aligning and attaching a convergence cup to the final focus electrode, comprising:

providing a carrier plate having three beam-passing apertures of the same diameter and position as the beam-passing apertures in said final focus electrode;

aligning said carrier plate with said final focus electrode by locating tool means inserted through said outside beam-passing apertures of both said carrier plate and said final focus electrode;

bonding said carrier plate to said final focus electrode by welding means;

aligning the bonded combination of said carrier plate and said final focus electrode with said convergence cup by tooling pin means inserted through aligned like-size apertures in said carrier plate and said convergence cup and located away from said beam passing apertures; and bonding said combination and said convergence cup by welding means.

2. The method defined by claim 1 wherein said final focus electrode is comprised of two separate sections wherein the section closest to said carrier plate is bonded first to said carrier plate before being bonded to the other of the said two sections comprising said final focus electrode.

* * * * *